US006290050B1

(12) United States Patent
Mikami et al.

(10) Patent No.: US 6,290,050 B1
(45) **Date of Patent: *Sep. 18, 2001**

(54) COIN-PROCESSING DEVICE

(75) Inventors: Mitsugu Mikami, Kawagoe; Kenji Nakajima, Iruma-gun, both of (JP)

(73) Assignee: Kabushiki Kaisha Nippon Conlux, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/304,754

(22) Filed: May 4, 1999

(30) Foreign Application Priority Data

May 8, 1998 (JP) ..... 10-126054

(51) Int. Cl.[7] ..... G07D 1/00
(52) U.S. Cl. ..... 194/350
(58) Field of Search ..... 194/350; 453/19–29, 453/36–49

(56) References Cited

U.S. PATENT DOCUMENTS 3,942,543 * 3/1976 Crowell et al. ..... 453/21 X
5,400,891 * 3/1995 Winstanley ..... 194/350

* cited by examiner

*Primary Examiner*—F. J. Bartuska
(74) *Attorney, Agent, or Firm*—Hogan & Hartson, LLP

(57) ABSTRACT

A coin-processing device allowing simple maintenance and inspection, wherein a bottom base (30) constituting a coin payout section (6) of a processing device (20) is installed slidably with respect to the device main unit (21) from the front face (20*a*) thereof.

10 Claims, 9 Drawing Sheets

COIN-PROCESSING DEVICE

BACKGROUND OF THE INVENTION

1. Field of the Invention

The present invention relates to a coin-processing device installed in a machine such as an automatic vending machine, currency exchange machine or the like, which determines the authenticity of coins inserted thereinto, and furthermore, sorts and holds coins regarded to be authentic according to denomination and selectively pays out coins in accordance with an amount of change.

2. Description of the Related Art

Generally, a coin-processing device for judging the authenticity of inserted coins, sorting and holding coins regarded to be authentic according to denomination, and, if an amount of change is determined, selectively paying out coins in accordance with this amount of change, is installed in machines, such as automatic vending machines and the like.

In broad terms, such coin-processing devices are constituted by three elements, namely:

(1) Coin sorting section for receiving inserted coins, judging the authenticity of the inserted coins and sorting same, and separating and sorting the coins regarded to be authentic into different denominations;

(2) Coin holding section comprising a plurality of coin tubes for collecting and holding the coins separated and sorted by the coin sorting section, for each denomination of coin; and (3) Paying out section for selectively paying out coins corresponding to an amount of change from the coin holding section, in cases where an amount of change is established.

FIG. 8 is a schematic perspective view of a conventional coin-processing device 1 wherein the constituent elements are installed inside a device main unit consisting of a frame.

In the conventional coin-processing device 1, the device main unit 3 consisting of a frame having an approximate square U-shaped cross-section which accommodates the three constituent elements described above is installed detachably on the rear face 2*a* of a door 2 provided in an automatic vending machine or the like (not illustrated), by means of fixing means, such as screws or the like.

Inside the main unit 3 of the coin-processing device 1, a coin sorting section 4 in which a coin receiving inlet 4*a* is formed, a coin holding section 5 comprising a plurality of coin tubes and a coin payout section 6 are provided, in this order from top to bottom.

There are also provided on the door 2, in a position below the coin payout section 6, a coin payout chute 7 along which coins paid out by the coin payout section 6 (change coins or coins regarded to be false) are discharged to a commonly known coin payout opening formed in the front face of the door 2 and a cash box 9 for holding coins overflowing from the coin holding section 5. The respective upper ends 7*a*, 9*a* of the coin payout chute 7 and the cash box 9 are positioned adjacently to the lower face of the coin payout section 6, that is, the lower face of a bottom base 8 constituting the lowest portion of the coin payout section 6.

The upper ends 7*a*, 9*a* of the coin payout chute 7 and the cash box 9 are located extremely proximate to the lower face of the bottom base 8, in such a manner that coins dropping from the lower face of the bottom base 8 do not spill into the gap therebetween.

On some occasions, the various components installed in the device main unit 3 are removed from the main unit 3, for instance, when there is a coin jam inside the constituent elements, or during maintenance and inspection work for carrying out tasks such as cleaning, and the like.

Referring to FIG. 9, when the coin sorting section 4 is detached from the device main unit 3 in the conventional coin-processing device 1 on such occasion, the latches of latching means (not illustrated) for coupling the device main unit 3 and the coin sorting section 4 together are released, and the coin sorting section 4 is removed from the front of the device main unit 2, as indicated from the arrow A. Then, maintenance and inspection work is carried out on this coin sorting section 4. When the maintenance and inspection work has been completed, the coin sorting section 4 is installed in the device main unit 2 by carrying out an operation opposite to the foregoing operation.

Referring to FIG. 10, when conducting maintenance and inspection of the coin holding section 5 comprising a plurality of coin tubes, the latches of latching means (not illustrated) for coupling the device main unit 3 and the coin holding section 5 together are released. Then, the coin holding section 5 is removed from the front of the device main unit 3 as indicated by arrow B, and maintenance and inspection work is carried out on the coin holding section 5. When this work has been completed, the coin holding section 5 is installed in the device main unit 3 by carrying out an operation opposite to the foregoing operation.

Furthermore, when conducting maintenance and inspection of the coin payout section 6 installed inside the device main unit 3, it is necessary to remove the bottom base 8 constituting the lowest face of the coin payout section 6 from the device main unit 3.

For the purpose of conducting the above operations, in the conventional coin-processing device 1, as shown in FIG. 8, the rear end of the bottom base 8 is supported rotatably about a shaft 8*a* which engages with L-shaped cut-outs 3*a* formed in either side of the device main unit 3, and the front end thereof is supported detachably by latching means 10 comprising coupling pins 9 which can be inserted into holes 3*b* formed in the sides of the device main unit 3. To remove the bottom base 8, after releasing the latches of latching means 10, the bottom base 8 is caused to rotate about the holes 3*b* formed in the sides of the device main unit 3, whereby the upper face of the bottom base 8 is opened up in such a manner that maintenance and inspection tasks, such as removing coins jammed therein, or the like, can be carried out.

A latch lever (not illustrated) for operating the latching means 10 is provided in the bottom base 8, and a structure is adopted whereby this lever cannot be operated from the front side of the bottom base 8.

As described above, since the coin sorting section 4 and coin holding section 5 can be removed individually from the front of the device main unit 3 by releasing the latches of the respective latching means for the coin sorting section 4 and coin holding section 5, when carrying out maintenance and inspection of the coin-processing device 1, there are no particular problems relating to workability for maintenance and inspection tasks. However, since the respective upper ends 7*a*, 9*a* of the coin payout chute 7 and the cash box 9 are positioned adjacently to the lower face of the bottom base 6 constituting the base of the coin payout section 6, as shown in FIG. 8, it is not possible directly to release the latches of the latching means 10 and rotate the bottom base 8 about the holes 3a formed in the sides of the device main unit 3, when the device main unit 3 is attached to the door 2. Therefore, when carrying out maintenance and inspection tasks relating to the coin payout section 6, it is necessary first to remove the coin-processing device 1 itself from the door 2 of the automatic vending machine, or other such machine, as shown in FIG. 11. Then, the latches of the latching means 10 are released and the bottom base 8 is rotated about the holes 3*a* formed in the sides of the device main unit 3, thereby opening up the upper face of the bottom base 8 as indicated by arrow C. Furthermore, when these operations have been completed, it is necessary to carry out the task of attaching the coin-processing device 1 again to the automatic vending machine, or other such device, illustrated in FIG. 8. Consequently, there has been a drawback in that such maintenance and inspection tasks are extremely complicated.

SUMMARY OF THE INVENTION

The present invention was devised with the foregoing in view, and an object the present invention is to provide a coin-processing device whereby maintenance and inspection tasks are made simple.

In order to achieve this object, the present invention provides a coin-processing device comprising a coin payout section for paying out coins in accordance with an amount of change, the coin payout section being positioned in the lowest portion of a main unit of the coin-processing device, wherein a bottom base forming a base portion of the coin payout section is installed slidably with respect to the main unit of the device, from the front face thereof.

In the present invention, since the bottom base of the coin payout section constituting the lowest portion of the coin-processing device is supported slidably with respect to the main unit of the device, from the front face thereof, it is not necessary to remove the device main unit itself from its installation position on the door of an automatic vending machine or the like, when carrying out maintenance and inspection tasks with respect to the coin payout section. Consequently, the bottom base can be removed from the device main unit by means of a simple operation, and maintenance and inspection tasks, such as removing coins jammed therein, cleaning, and the like, can be carried out in an extremely simple manner.

DESCRIPTION OF THE PREFERRED EMBODIMENTS

Embodiments of a coin-processing device according to this invention are described below while referring to the accompanying drawings.

Figure 1:
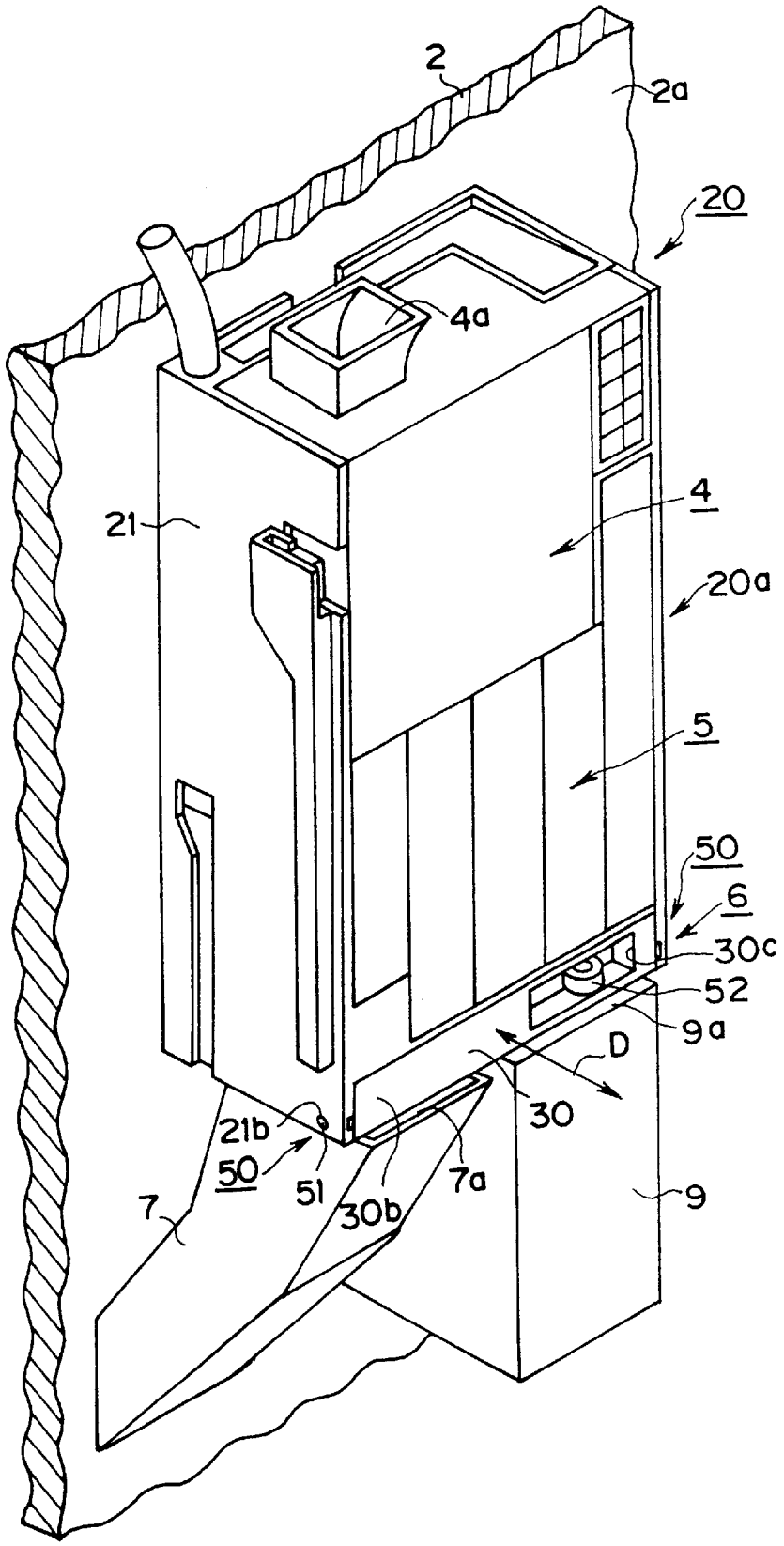
FIG. 1 is a schematic perspective view of a coin-processing device according to a first embodiment of this invention.
Figure 8:
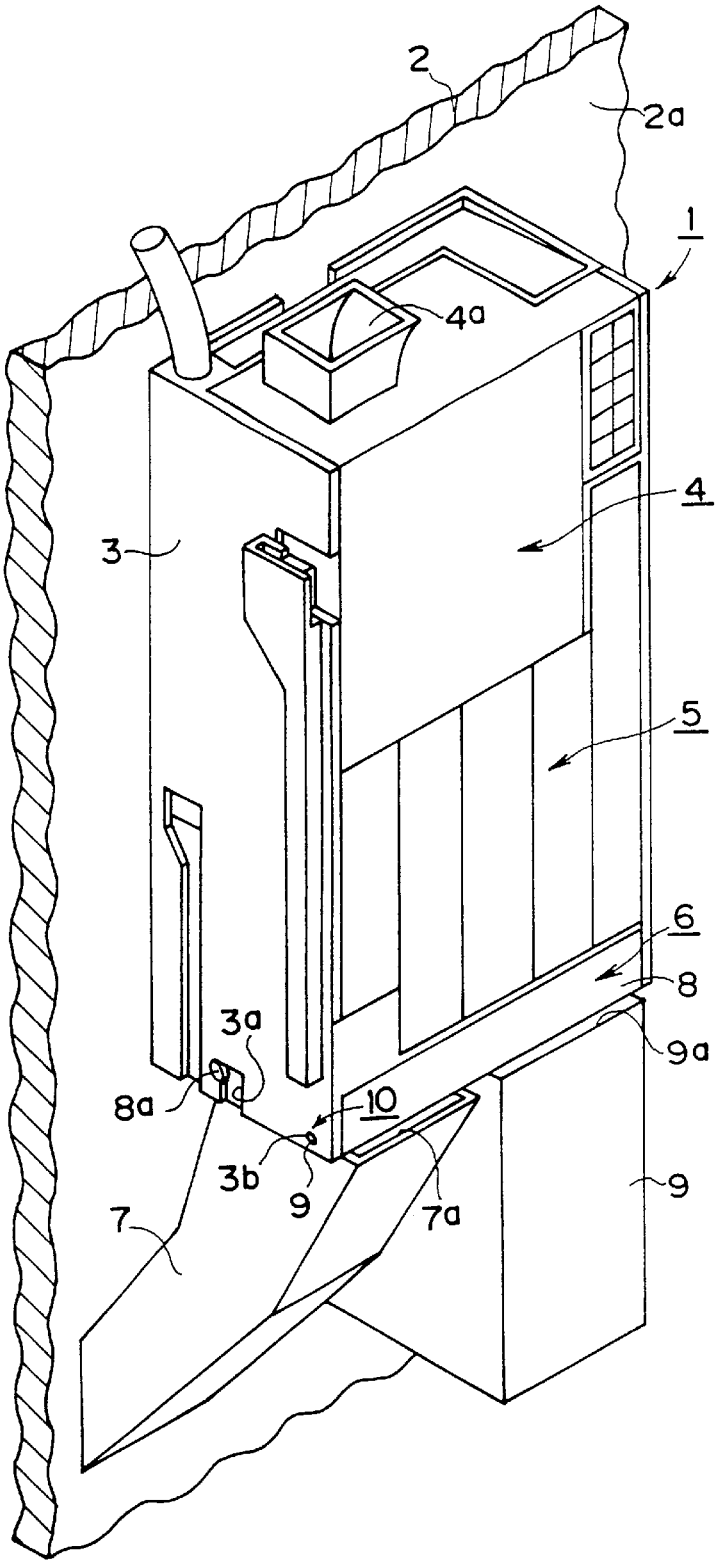
FIG.8 (PRIOR ART)
FIG. 8 is a schematic perspective view of a conventional coin-processing device.
Figure 9:
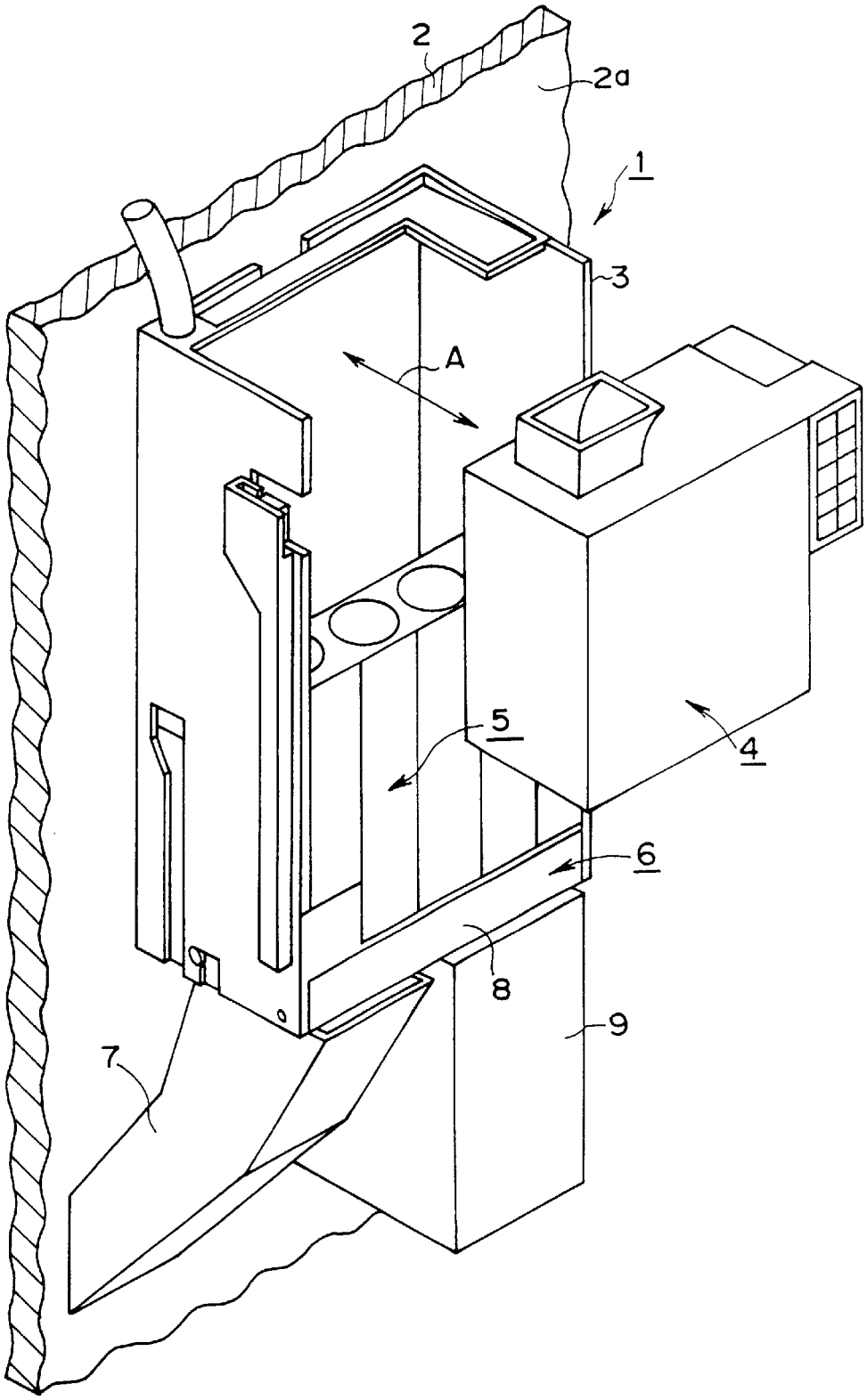
FIG.9 (PRIOR ART)
FIG. 9 is a schematic perspective view showing a state where the coin sorting section has been removed in the conventional device.
Figure 10:
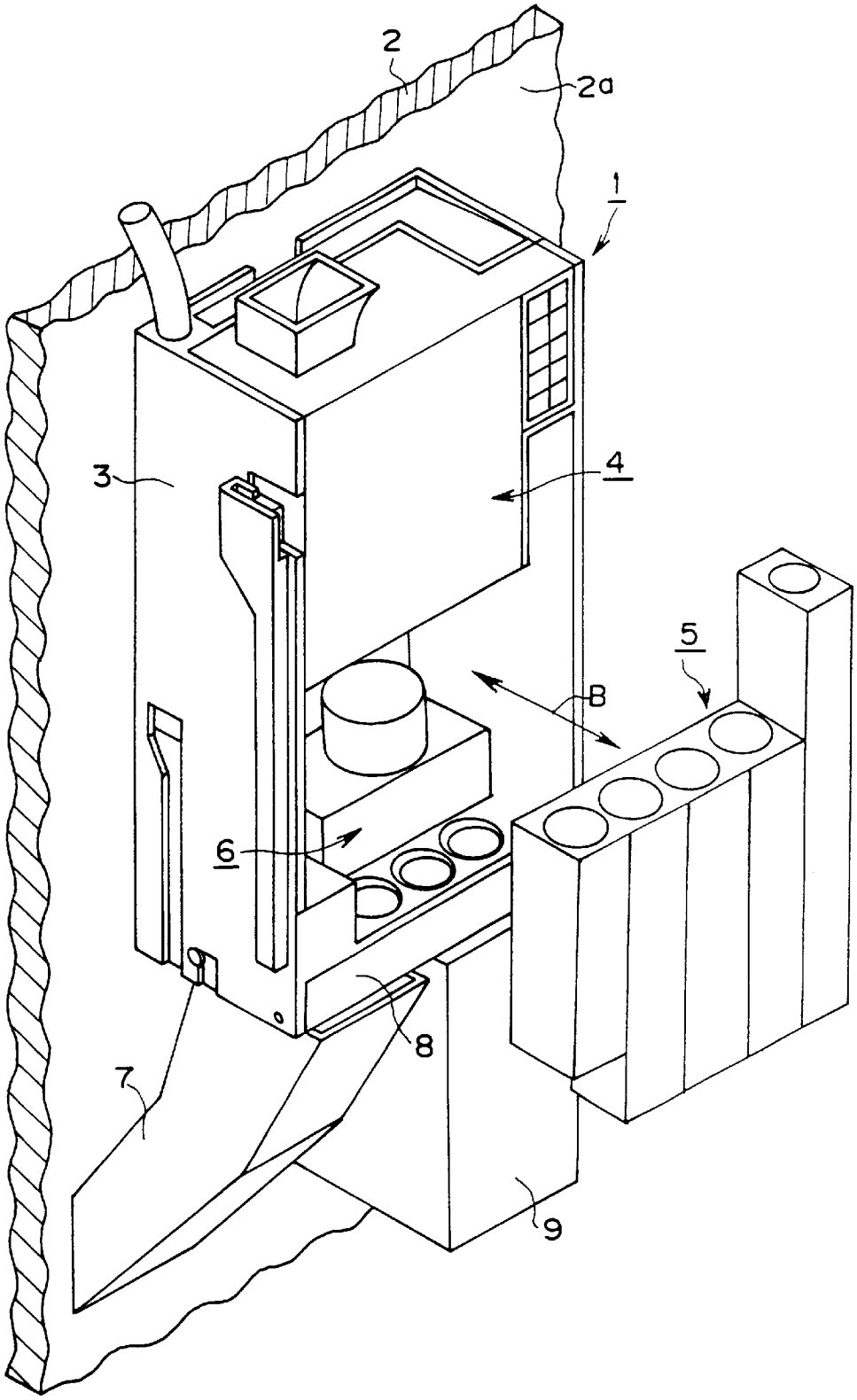
FIG.10 (PRIOR ART)
FIG. 10 is a schematic perspective view showing a state where the coin holding section has been removed in the conventional device.
Figure 11:
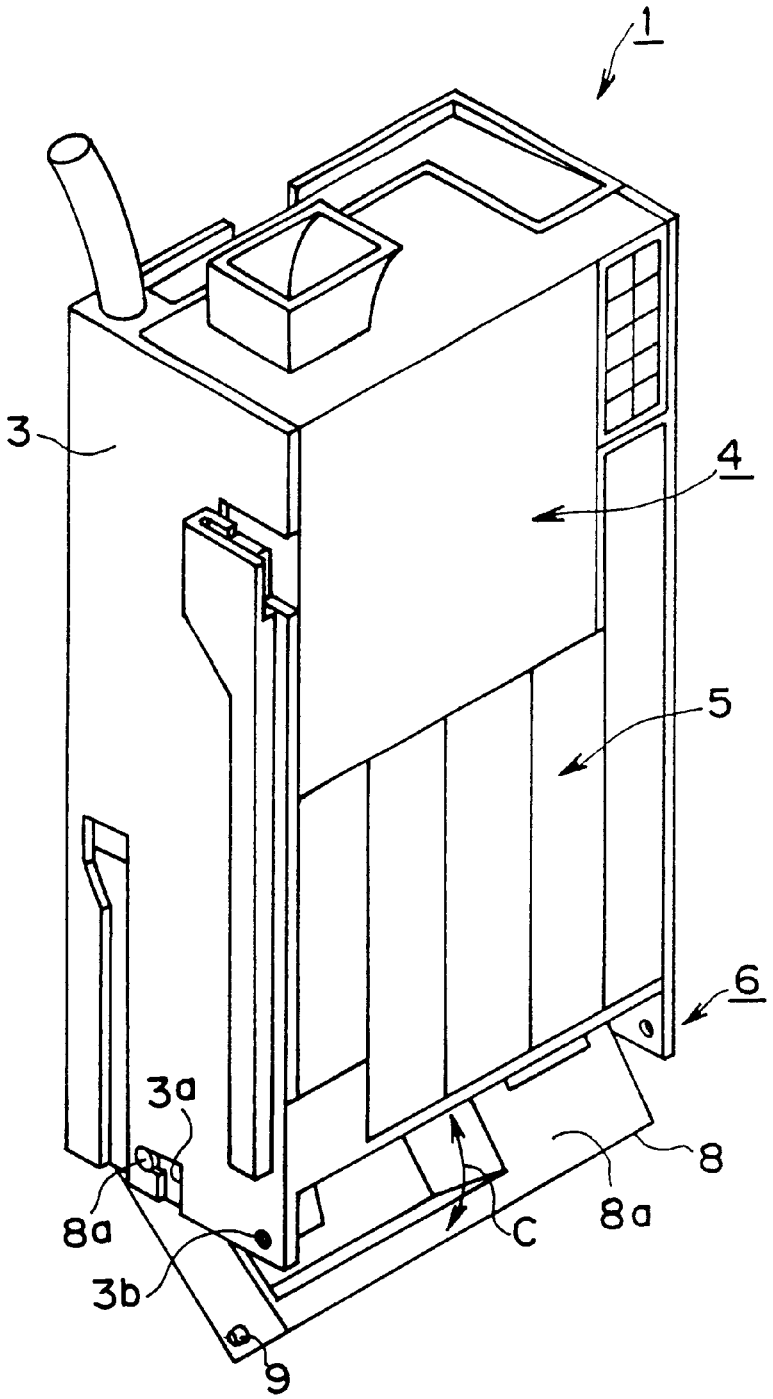
FIG.11 (PRIOR ART)
FIG. 11 is a schematic perspective view showing a state where the bottom base has been removed in the conventional device.

FIG. 1 is a schematic perspective view of a coin-processing device 20 according to the first embodiment of this invention in which the same reference numerals are used for parts which are the same as those in FIG. 8, wherein the coin-processing device is illustrated in a state where it is attached to the rear face 2*a* of a door 2 of a machine such as an automatic vending machine or the like.

In the coin-processing device 20 of the first embodiment, a device main unit 21 constituted by a frame having an approximately square U-shaped cross-section, is attached removably to the rear face 2*a* of the door 2, by means of fixing means such as screws or the like, in a similar manner to the conventional device.

Also similarly to the conventional device, there are provided inside the device main unit 21, from top to bottom in this order, a coin sorting section 4, a coin holding section 5 comprising a plurality of coin tubes, and a coin payout section 6, which constitute the principal constituent elements of the coin-processing device.

Furthermore, similarly to the conventional device, a coin payout chute 7 for discharging coins paid out by the coin payout section 6 (change coins, or coins regarded to be false) to a commonly known coin payout opening formed in the front face of the door 2, and a cash box 9 for holding coins overflowing from the coin holding section 5 are also provided on the door 2 which is located in a position below the coin payout section 6. Respective upper ends 7*a*, 9*a* of these elements are located adjacently to the lower face of the coin payout section, in other words, the lower face of a bottom base 30 which constitutes the lowest portion of the coin payout section 6.

The respective upper ends 7*a*, 9*a* of the coin payout chute 7 and the cash box 9 are both located extremely proximate to the lower face of the bottom base 30, in such a manner that coins dropping from the lower face of the bottom base 30 do not spill into the gap therebetween.

On the other hand, the bottom base 30 constituting the lowest portion of the coin payout section 6 is supported inside the device main unit 21 by sliding support means 40 (described hereinafter) interposed between both inner sides of the device main unit 21 and both sides of the bottom base 30, in such a manner that it can be pulled out from the front side 20*a* thereof, with respect to the coin-processing device 20, in the direction indicated by arrow D.

Figure 2:
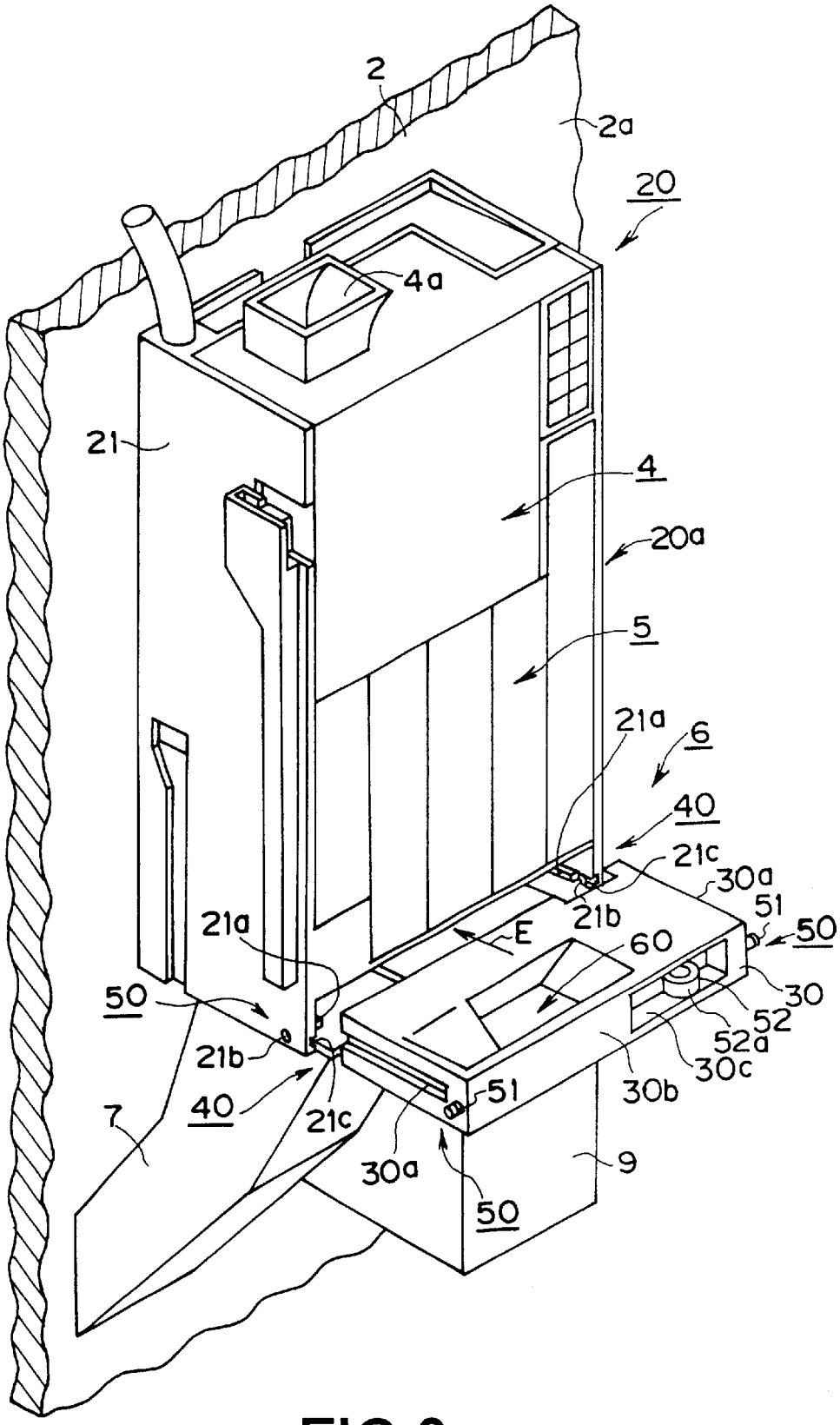
FIG. 2 is a schematic perspective view of a coin-processing device showing a state where the bottom base has been pulled out in the first embodiment.

As shown in FIG. 2 illustrating a state where the bottom base 30 is pulled out from the device main unit 21, the sliding support means 40 is constituted by a pair of guide rails 21*a*, which project from either inner side of the device main unit 21, and a pair of guide grooves 30*a* formed in either side of the bottom base 30, which engage with the pair of guide rails 21*a*.

On the other hand, latching means 50 for positioning and engaging the bottom base 30 inside the device main unit 21 is formed between the bottom base 30 and the device main unit 21, as illustrated in FIG. 2.

This latching means 50 is constituted by a pair of coupling holes 21*b* provided on either side of the end portion of the device main unit 21, and a pair of coupling pins 51 which are provided in the bottom base 30 in such a manner that they can be inserted into the coupling holes 21*b*, the pair of coupling pins 51 being provided such that they can be withdrawn from the sides of the bottom base 30 by an operation of a latch lever 52 provided in the front face 30*b* of the bottom base 30.

The latch lever 52 is provided inside a recess 30*c* formed in the front face 30*b* of the bottom base, and it is formed in such a manner that the tip 52*a* thereof does not project beyond the front face 30*b* of the bottom base.

Figure 3:
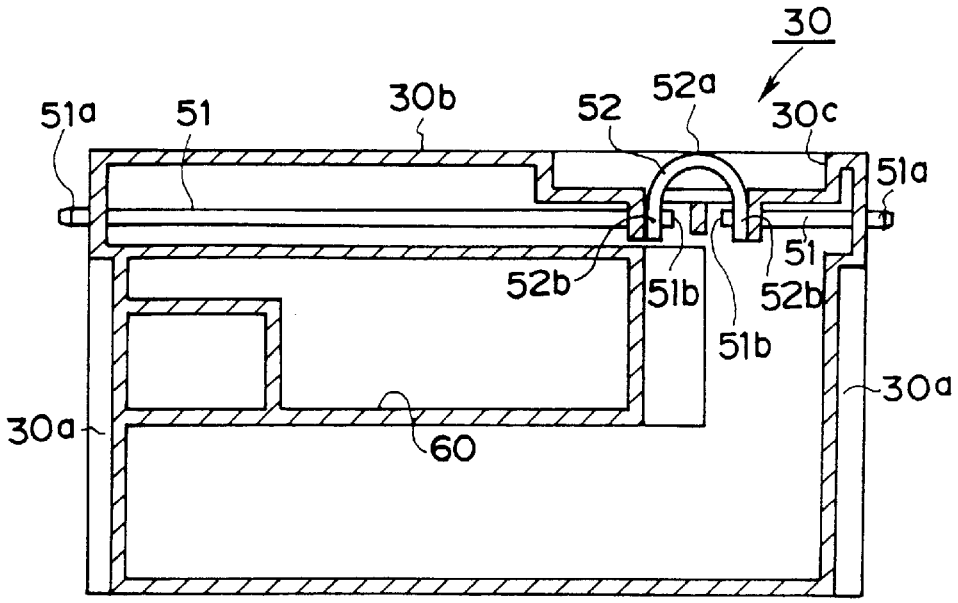
FIG. 3 is an enlarged sectional view of the lower face of the bottom base in the first embodiment.

The latch lever 52 is formed by a spring member having a U-shaped cross-section, as illustrated in FIG. 3 which shows an enlarged sectional view of the lower face of the bottom base 30, and the free ends 52*b* thereof are positioned respectively against the rear ends 51*b* of the pair of coupling pins 51.

Figure 4:
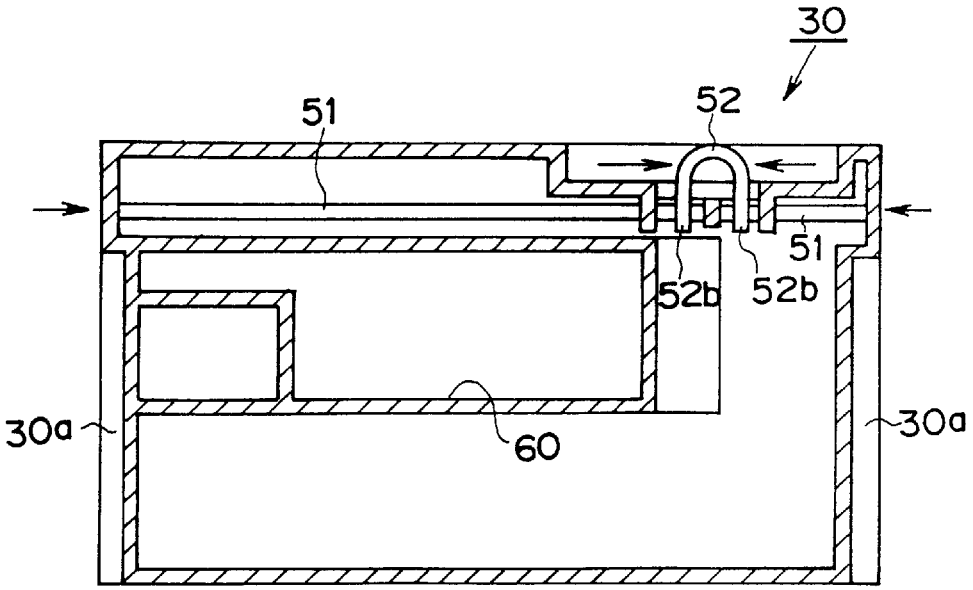
FIG. 4 is an enlarged sectional view of the lower face of the bottom base in the first embodiment.

By means of this latch lever 52 constituted by a spring member, when the free ends 52*b* thereof are compressed, as shown by the arrows in FIG. 4, against the spring force pushing the free ends apart, the respective front ends 51*a* of the pair of coupling pins 51 (FIG. 3) are withdrawn inside the bottom base 30.

When the bottom base 30 is in an installed state as illustrated in FIG. 1, and an operator then inserts his or her finger into the recess 30*c* formed in the front face 30*b* of the bottom base and depresses the latch lever 52, the engagement between the coupling holes 21*b* (FIG. 2) and the coupling pins 51 interlocking into these coupling holes 21*b* is released. When the operator then pulls the latch lever 52 which he or she is holding, away from the front face 20*a* of the coin-processing device 20, as indicated by arrow D (FIG. 1), it is possible to draw out only the bottom base 30 completely from the device main unit 21 and to remove the bottom base 30, as illustrated by FIG. 2. Thus, maintenance and inspection tasks, such as cleaning, can be carried out in this state.

If the bottom base 30 is in the drawn-out state shown in FIG. 2 and the operator then pushes the bottom base 30 into the device main unit 21 as indicated by arrow E, then the guide rails 21*a* of the device main unit 21 are inserted into the guide grooves 31*a* of the bottom base 30, and the bottom base 30 interlocks with the device main unit 21, in addition to which, the front ends 51*a* of the pair of coupling pins 51 press against guide oblique faces 21*c* formed in corresponding positions on either inner side of the device main unit 21 and are retracted inside the bottom base 30 thereby, whereupon, when the front ends of the pair of coupling pins 51 reach positions corresponding to the coupling holes 21*b*, the pair of coupling pins 51 interlock into the coupling holes 21*b*, thereby coupling the device main unit 21 and the bottom base 30.

Consequently, the bottom base 30 is located and held in a prescribed base position inside the device main unit 21, as shown by FIG. 1.

In FIGS. 2, 3 and 4, numeral 60 is a coin payout hole formed in the bottom base 30: this coin payout hole 60 connects to the upper end of the coin payout chute 7 and it guides coins paid out to the upper face of the bottom base 30 into the coin payout chute 7. In the foregoing embodiment, the latch lever 52 in the latching means 50 is formed by a spring member having a U-shaped cross-section, and the free ends thereof 52*b* were located inside the bottom base 30, but the present invention is not limited to the foregoing embodiment, and it is also possible for the free ends of the latch lever constituted by a spring member of U-shaped cross-section to be located on the front face 30*b* of the bottom base.

Figure 5:
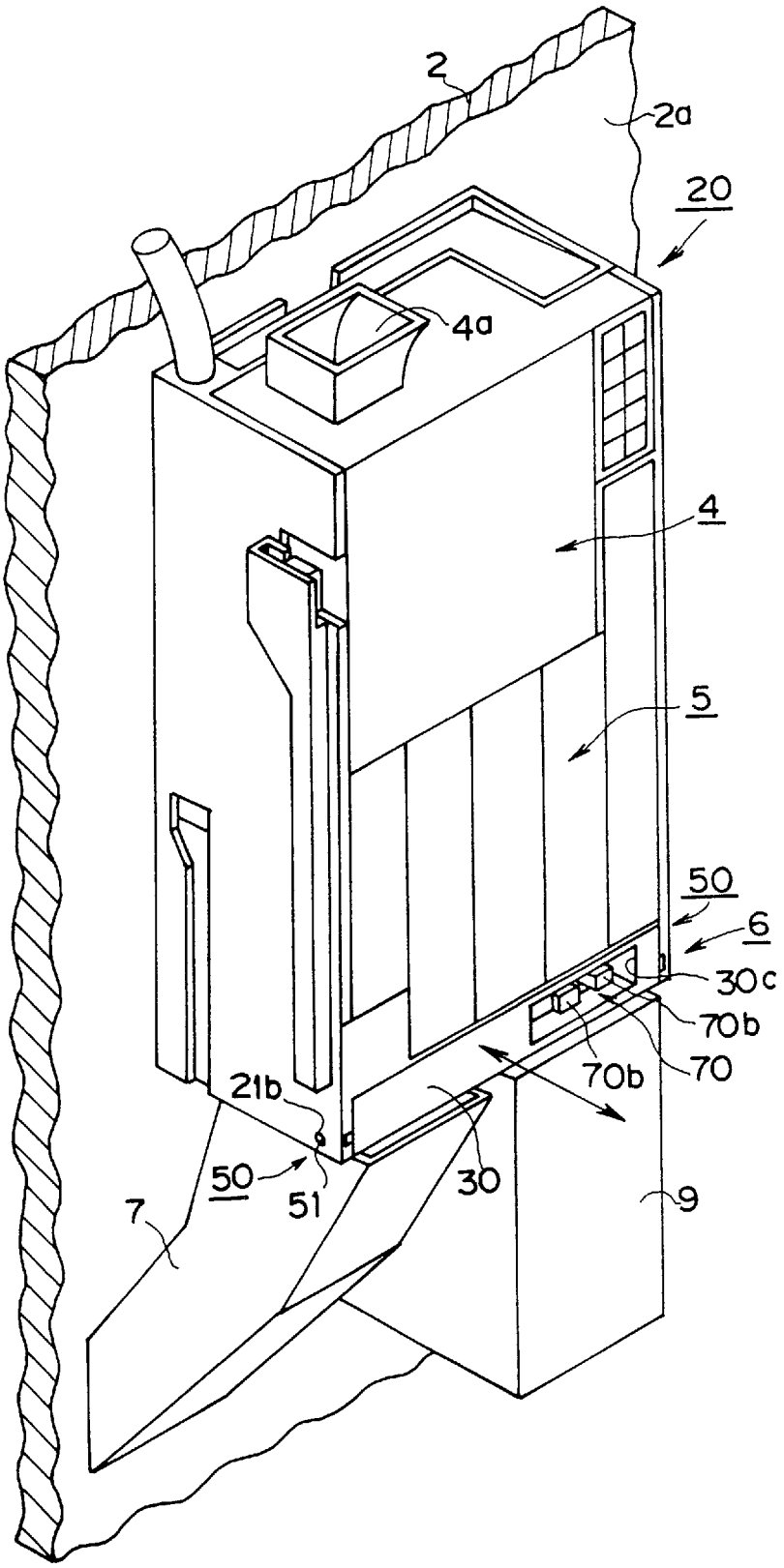
FIG. 5 is a schematic perspective view of a coin-processing device according to the second embodiment.

FIG. 5 is a schematic perspective view showing the second embodiment wherein the free ends 70*b* of a latch lever 70 consisting of a spring member of approximately U-shaped cross-section are located inside the recess section 30*c* in the bottom base 30. The same numerals are used in FIG. 5 for the same parts in FIG. 1.

Figure 6:
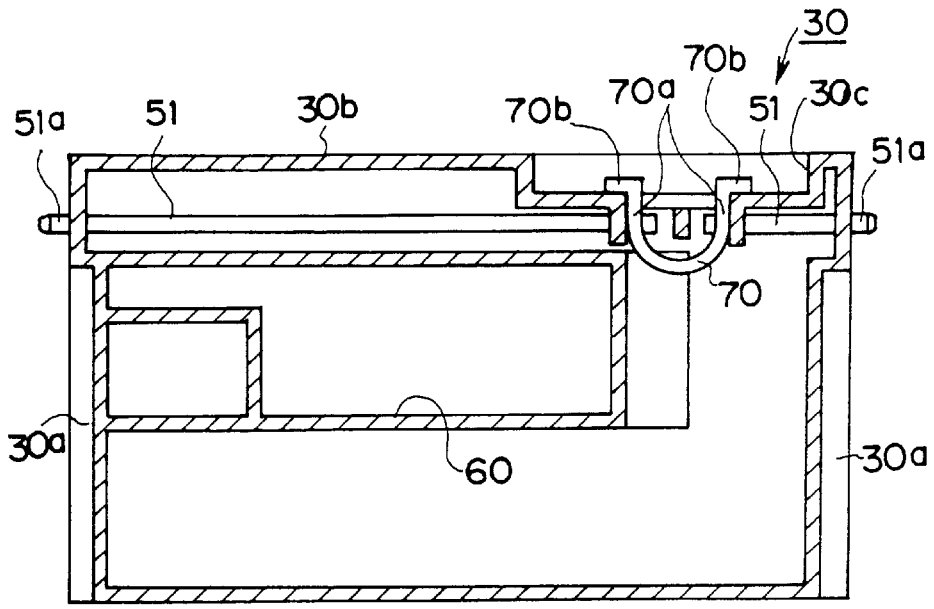
FIG. 6 is an enlarged sectional view of the lower face of the bottom base in the second embodiment.
Figure 7:
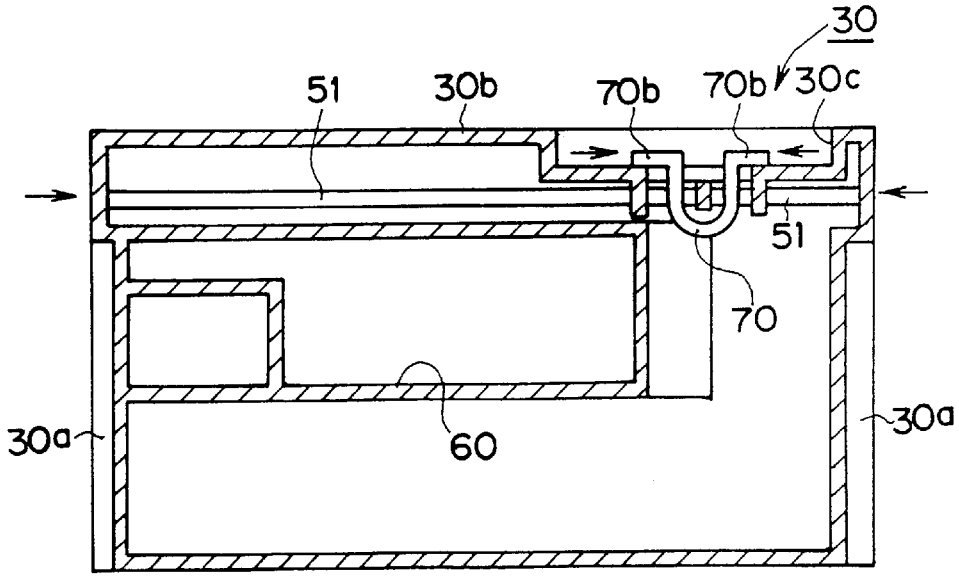
FIG. 7 is an enlarged sectional view of the lower face of the bottom base in the second embodiment.

The tips 70*b* of the free ends 70*a* of this latch lever 70 having a U-shaped cross-section are respectively bent and positioned inside the recess 30*c*, as illustrated in FIG. 6 which gives an enlarged sectional view of the lower face of the bottom base 30. With a latch lever 70 of this kind, similarly to the latch lever 52 shown in FIGS. 3 and 4, when the two tips 70*b* of the free ends thereof are compressed, as indicated by the arrows in FIG. 7, against the spring force pushing the free ends 70*a* apart, then the front ends 51*a* of the pair of coupling pins 51 (FIG. 6) are drawn inside the bottom base 30, thereby releasing the latching means.

In the foregoing embodiments, of the pair of guide rails 21*a* and the pair of guide grooves 30*a* constituting the sliding support means 40, the pair of guide rails 21*a* are formed in the device main unit 21 and the pair of guide grooves 30*a* are formed in the bottom base 30. However, the invention is not limited to these embodiments, and it is also possible for the pair of guide rails 21*a* to be formed in the bottom base 30 and the pair of guide grooves 30*a* to be formed in the device main unit 21.

Furthermore, in the foregoing embodiments, the respective cross-sectional shape of the pair of guide rails 21*a* and the pair of guide grooves 30*a* was a square shape, but the invention is not limited to the foregoing embodiments, and this cross-sectional shape is not restricted, provided that it provides mutual engagement between the members, for instance, it may be an arc shape.

Moreover, the shape of the latch levers 52, 70 of the latching means 50 is not limited to the foregoing embodiments, for example, grooves may be formed in the sides of the latch levers 52, 70 in order to facilitate the bottom base 30 withdrawing operation, or projections may be formed thereon in order to make the lever easier for the operator to grasp.

What is claimed is:

1. A coin-processing device comprising:

a main unit having a front face;

a coin payout section for paying out coins in accordance with an amount of change, the coin payout section being positioned within a lower portion of the main unit; and a bottom base forming a base portion of the coin payout section, slidably installable and removable from the front face independently from the rest of the coin payout section.

2. The coin-processing device according to claim 1, further comprising sliding support means for slidably supporting the bottom base with respect to the main unit.

3. The coin-processing device according to claim 2, wherein the sliding support means comprises guide rails and guides grooves engaging with the guide rails.

4. The coin-processing device according to claim 3, wherein the guide rails are formed in the main unit, and the guide grooves are formed in the bottom base.

5. The coin-processing device according to claim 3, wherein the guide rails are formed in the bottom base and the guide grooves are formed in the main unit.

6. The coin-processing device according to claim 1, further comprising latching means for positioning and engaging the bottom base with respect to the main unit.

7. The coin-processing device according to claim 6, wherein the latching means comprises a coupling hole provided in a side of the main unit, a coupling pin supported inside the bottom base in such a manner that it can be inserted into the coupling hole, and a latch lever provided in the front face of the bottom base, which is capable of elastic deformation for causing the coupling pin to be inserted into or withdrawn from the bottom base.

8. The coin-processing device according to claim 7, wherein the latch lever is located in a recess formed in the front face of the bottom base, and a fore end thereof is located in such a manner that it does not project beyond the front face of the bottom base.

9. A coin-processing device comprising:

a main unit;

a coin payout section for paying out coins in accordance with an amount of change, the coin payout section being positioned within a lower portion of the main unit;

a bottom base forming a base portion of the coin payout section, and capable of being slidably installed to the main unit from the front fact thereof; and latching means for positioning and engaging the bottom base with respect to the main unit, the latching means comprising a coupling hole disposed on a side of the main unit, a coupling pin disposed within the bottom base for insertion into the coupling hole, and a latch lever on a front face of the bottom base for inserting or withdrawing the coupling pin.

10. The coin-processing device according to claim 9, wherein the latch lever is located in a recess formed in the front face of the bottom base, and a front end thereof does not project beyond the front face of the bottom base.

* * * * *